US009021711B2

(12) United States Patent
Segreti

(10) Patent No.: US 9,021,711 B2
(45) Date of Patent: May 5, 2015

(54) MECHANICAL DRAWING BOARD

(71) Applicant: Mario J. Segreti, Washington, DC (US)

(72) Inventor: Mario J. Segreti, Washington, DC (US)

( * ) Notice: Subject to any disclaimer, the term of this patent is extended or adjusted under 35 U.S.C. 154(b) by 220 days.

(21) Appl. No.: 13/763,285

(22) Filed: Feb. 8, 2013

(65) Prior Publication Data

US 2013/0305546 A1 Nov. 21, 2013

Related U.S. Application Data

(60) Provisional application No. 61/633,436, filed on Feb. 11, 2012, provisional application No. 61/743,474, filed on Sep. 5, 2012.

(51) Int. Cl.

| | |
|---|---|
| ***A47B 27/00*** | (2006.01) |
| ***B43L 5/00*** | (2006.01) |
| ***B43L 5/02*** | (2006.01) |

(52) U.S. Cl.
CPC .... *B43L 5/00* (2013.01); *B43L 5/02* (2013.01)

(58) Field of Classification Search
USPC ..... 33/1 B, 1 G, 18.1, 42, 430, 437, 438, 474
See application file for complete search history.

(56) References Cited

U.S. PATENT DOCUMENTS

| | | | | |
|---|---|---|---|---|
| 2,060,355 | A | 11/1936 | Twomley | |
| 3,465,445 | A * | 9/1969 | Fisher | 33/27.03 |
| 3,950,853 | A * | 4/1976 | Andrew | 33/438 |
| 4,539,759 | A * | 9/1985 | Dowzall et al. | 33/615 |
| 4,833,784 | A * | 5/1989 | Rivera | 33/18.1 |
| 6,108,922 | A * | 8/2000 | Lee | 33/430 |
| 6,182,549 | B1 * | 2/2001 | Albright et al. | 83/454 |
| 8,166,663 | B2 * | 5/2012 | Elias | 33/474 |
| 2002/0066195 | A1 * | 6/2002 | Gwon | 33/437 |
| 2010/0077624 | A1 * | 4/2010 | Elias | 33/474 |

OTHER PUBLICATIONS

Photos of Dietzgen Pretty Neat Drawing Board. Date unknown but prior to the US filing date of the present application.

* cited by examiner

*Primary Examiner* — G. Bradley Bennett
(74) *Attorney, Agent, or Firm* — Timothy J. Klima; Shuttleworth & Ingersoll, PLC

(57) ABSTRACT

An apparatus for securing and drawing upon a piece of paper, includes a board having a drawing surface sized to receive the paper. The drawing surface is bounded along its perimeter by a border region. An array of border pieces is fastened securely to the border region, each border piece being aligned relative to the others to establish a precisely sized drawing surface area to accommodate the paper. Each border piece has a length shorter than that of the corresponding edge of the drawing surface.

18 Claims, 4 Drawing Sheets

MECHANICAL DRAWING BOARD

The application claims priority to U.S. Provisional Patent Application 61/633,436 filed Feb. 11, 2012 and U.S. Provisional Patent Application 61/743,474 filed Sep. 5, 2012, and the entire contents of both applications are incorporated by reference herein.

This invention relates to drafting or drawing boards, to drawing instruments, and to related apparatus and, in particular, instruments to facilitate learning the skills and techniques of mechanical drawing.

The making of engineering and manufacturing drawings is conventionally done by draftsmen working with appropriate mechanical or computerized apparatus. Acquiring the skills necessary for proficient use of such apparatus necessarily requires access to apparatus that teach the techniques used in producing an image of an object on paper or computer. Where the object is to be drawn on paper, rulers, compass, triangles and the like are used to produce the image, Mechanical drawing apparatus is typically expensive, cumbersome, and too expensive for many schools to acquire for their pupils. Hence, the number of people, school-aged children in particular, who are exposed at an early age to technical drawing principles, is limited.

There is a need for a simpler, smaller, more cost effective instrument for instructing and performing fundamental drafting techniques, which techniques form the basis for proficient use of computer-based drafting tools.

DRAWINGS

The invention is illustrated by way of example with reference to the accompanying drawings, in which.

DETAILED DESCRIPTION

Figure 1:
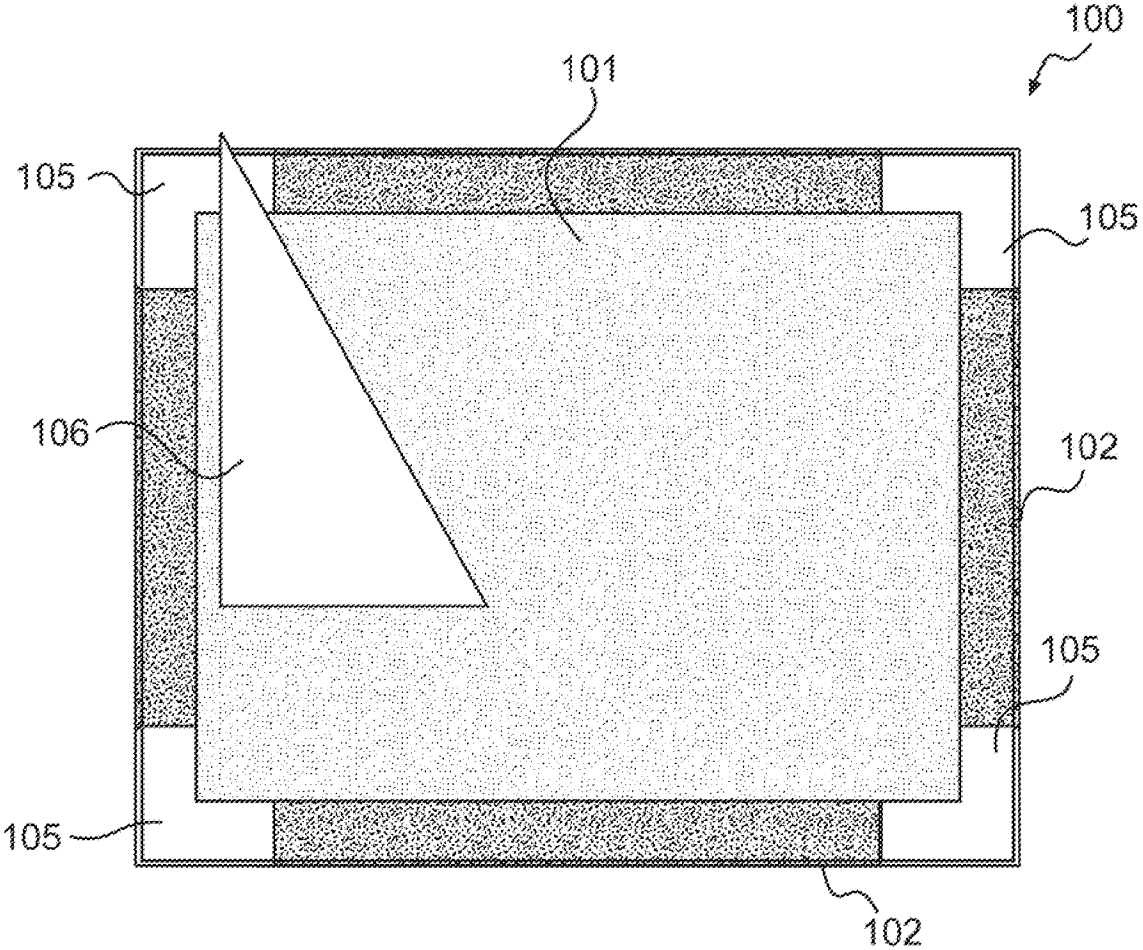
FIG. 1 is an overhead view of the drawing board configured in accordance with the present invention.

According to a first feature of the present invention there is provided drawing apparatus 100 comprising a board 110 having drawing surface 101 bordered partially on each side by raised border pieces 102 or edges fixed to an edge of the board 110 to accurately and securely position a piece of paper 103 (See FIG. 2) in preparation for drafting. In a common configuration shown in FIGS. 1 & 2, the drawing surface 101 is sized to accommodate a piece of paper 103 measuring 8 ½"×11." The apparatus 100 can be sized, of course, to accommodate any number of paper sizes.

Figure 2:
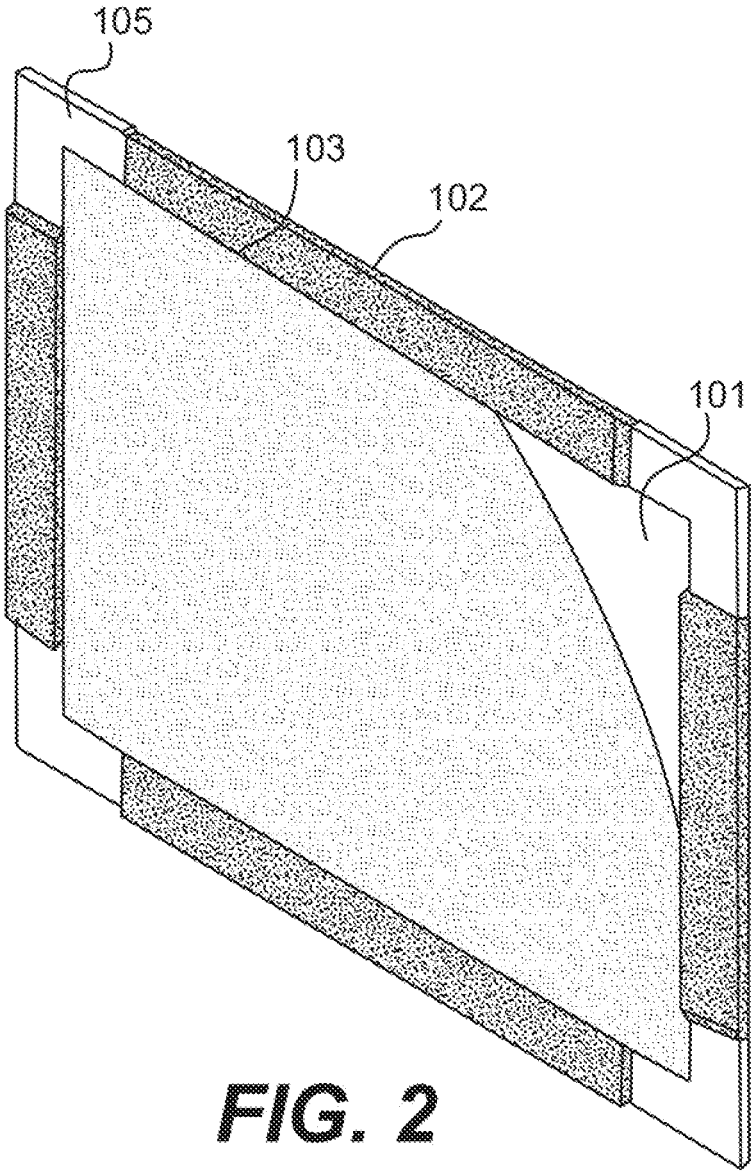
FIG. 2 is a perspective view of the drawing board of FIG. 1, showing a piece of drawing paper turned up at a corner.
Figure 3:
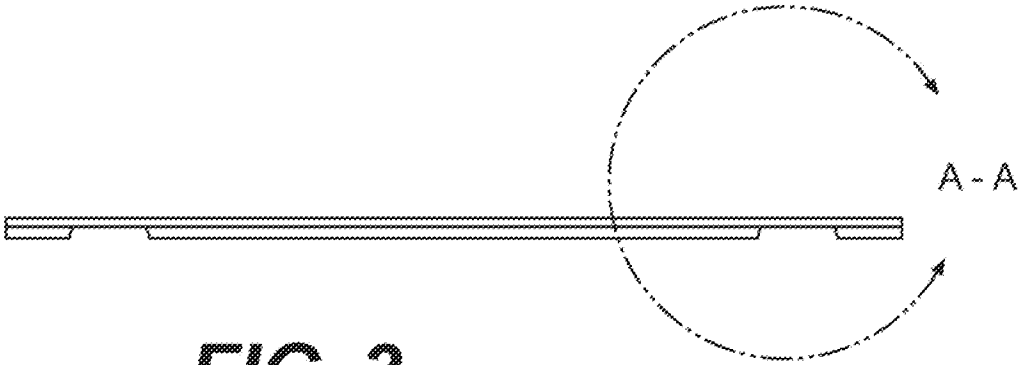
FIG. 3 is an edge view of the drawing board of FIG
Figure 4:
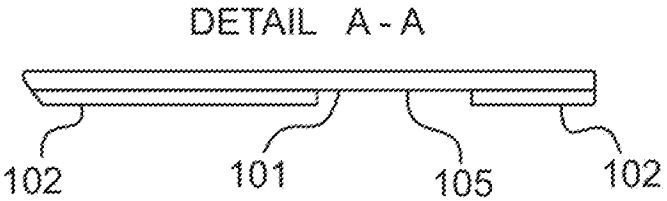
FIG. 4 is a enlarged view of a portion of FIG. 3 within the circ area approximated by line A-A.

As shown in FIG. 4, the border pieces 102 are attached to the drawing surface 101 to serve as guides for drawing instruments such as triangle 106. They are positioned such that when a piece of paper 103 is placed on the surface 101, the four pieces together serve to locate and hold the paper in place for drawing purposes The border pieces 102 are sized and positioned such that their ends do not meet at the corners, thereby leaving an open area 105 at each corner of the drawing surface 101. Each open area 105 is large enough to enable triangles and rulers to extend beyond the drawing surface 101 to not limit the effective drawing area on the paper. That is, the open areas 105 allow triangles or other instruments to be more freely manipulated within the drawing surface 101 without contacting and being restrained from movement by the border pieces 102. This is illustrated in FIG. 2, where the triangle 106 is shown with one of its comers extending through one of the corners 105.

The open corners 105 of the apparatus 100 effectively maximize the area of the paper 103 available for precision drawing with given instruments by increasing the range over which instruments can be manipulated on the paper 103. The border pieces 102 are long enough, however, to guide drawing instruments even when a given drawing tool is positioned such that a large portion is outside of the drawing surface 101.

A wide variety of drawing instruments may be selected to form part of a set or kit of instruments. Triangles, rulers, and curved instruments are sized to accommodate the size of the drawing board so as to easily utilize the entire drawing surface without being cumbersome. Triangles are provided in 45/45/90 and 30/60/90 angle configurations, with popularly-sized circles molded into the triangles so the user can readily create circles of the most commonly used sizes and draw lines at the most commonly used angles. A rectangular "spacer" piece can be used in conjunction with the triangles to provide more range of use of the triangles across the entire board.

In one particular embodiment of the present invention, the border pieces 102 fastened to the short sides of the rectangular drawing board are shortened as much as possible to maximize the range of use of a given drawing instrument by allowing for more of the instrument to overhang the edge of the drawing board.

In an alternative, a compartment located on the back side of the board is used to store drawing instruments. Using common practices and fasteners, such as hook & loop, such a compartment can be configured to attach to slots on the back of the board 110 for easy removal from the board 110 when the board 110 is being used.

The board can be efficiently manufactured from durable ABS plastic using an injection molding process. It can also be assembled using a durable material such as Masonite®. If molding the board from ABS plastic, it is known in the industry to include an additive in the molten plastic that reduces the amount of static electricity in the molded plastic. For a drawing board, having a charge of static electricity present has been found to be beneficial in that it can provide an effective method of holding a piece of paper 103 in place on the board 110. This allows the board 110 to be held at any angle while drawing. Accordingly, when fabricating the board from ABS plastic, foregoing such an additive is recommended.

In practice, before placing paper 103 on the board 110, generating static electricity in the board 110 is easily accomplished by rubbing the board 110 on the user's clothing for 10-15 seconds. This process generates enough static electricity to attract and hold the piece of paper 103 so that the user can hold the board in many orientations without fear that the paper 103 will fall from the board 110.

Figure 5:
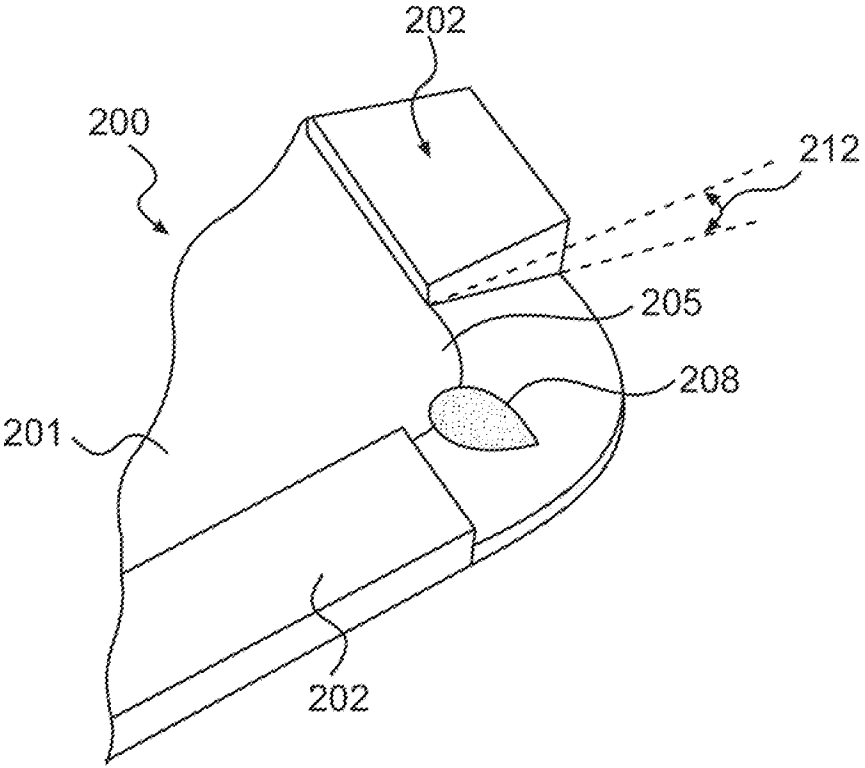
FIG. 5 is a perspective view of one corner of one embodiment of a drawing board having a tapered corner area with recessed areas used for grasping the drawing paper.

As can be seen in FIG. 5, each open corner 205 of drawing apparatus 200 has a small recessed area 208 to facilitate removal of the paper 103. The recesses 208 are located such that when a piece of paper is placed on the apparatus 200, the corners of the paper are positioned above respective recessed areas 208, thereby creating a gap between the board and the paper 103 so that the corner of the paper 103 can be easily grasped. This is especially useful when the paper 103 is attracted to the board by static electricity as mentioned above. In addition, the corner of the board can be designed with an outward (or inward) taper, illustrated as an angle 212, measured from the line parallel to the drawing surface 201. An angle is chosen such that when a sheet of paper 103 is in place on the apparatus 200, a gap exists between the corners of the paper 103 and the board. This gap, which is made larger when combined with space created by a recess 203, allows the paper 103 to be easily grasped for removal.

It is noted that an open area 205 in this embodiment of the drawing apparatus exists for the same purpose as in other embodiments of the invention. The open area can be varied in size by altering the length of the border pieces 202. Shorter border pieces 202 create a larger corner gap 205, which in turn allows larger drawing tools to be used on the board. It has been found helpful to use a board with longer border pieces 202 when the board is being used by younger people because the longer border pieces provides a wider, more stable base for the drawing tools.

The various components can be made of metals, plastics, composites, other materials or combinations thereof, and the dimensions, shapes, tolerances and configurations can be altered as desired. Any of the various aspects of the embodiments disclosed herein can be combined in different combinations to create new embodiments within the scope of the invention.

I claim:

1. An apparatus for securing and drawing upon a piece of paper, comprising:

a board having a drawing surface sized to receive the paper;

the drawing surface bounded along its perimeter by a border region;

an array of border pieces fastened securely to the border region, each border piece being aligned relative to the others to establish a precisely sized drawing surface area to accommodate the paper;

wherein each border piece has a length shorter than that of the corresponding edge of the drawing surface.

2. The apparatus of claim 1, wherein the border pieces have a thickness sufficient o support the paper and use of a drawing instrument within the drawing surface by moving the instrument along the border pieces to draw lines within a range of possible orientations.

3. The apparatus of claim 2, wherein the border pieces are centered on the border regions such that adjacent border pieces are separated from one another, thereby leaving portions of the border region uncovered by border pieces.

4. The apparatus of claim 3, wherein the uncovered border regions form corner regions of the drawing surface, the size of the corner regions being determined by lengths of the border pieces.

5. The apparatus of claim 4, wherein the corner regions are sized to provide stable support of a drawing instrument on the drawing surface while providing room for the drawing instrument to be located on the board such that a portion of the drawing instrument extends outside of the drawing surface and beyond the border region through the corner regions.

6. The apparatus of claim 5, wherein the drawing instrument is triangularly shaped.

7. The apparatus of claim 6, wherein at least one of the corner regions includes a recessed area at a location generally coinciding with a corner of the paper when placed on the drawing surface, such that a gap exists between the corner of the paper and the board to facilitate grasping of the paper.

8. The apparatus of claim 7, wherein the board comprises a material that retains an amount of static electricity sufficient to attract and retain the paper on the drawing surface.

9. The apparatus of claim 8, wherein the border pieces are fastened to the board in a location that holds the paper snugly and removably in place on the drawing surface.

10. The apparatus of claim 1, wherein the border pieces are centered on the border regions such that adjacent border pieces are separated from one another, thereby leaving portions of the border region uncovered by border pieces.

11. The apparatus of claim 10, wherein the uncovered border regions form corner regions of the drawing surface, the size of the corner regions being determined by lengths of the border pieces.

12. The apparatus of claim 11, wherein the corner regions are sized to provide stable support of a drawing instrument on the drawing surface while providing room for the drawing instrument to be located on the board such that a portion of the drawing instrument extends outside of the drawing surface and beyond the border region through the corner regions.

13. The apparatus of claim 12, wherein at least one of the corner regions includes a recessed area at a location generally coinciding with a corner of the paper when placed on the drawing surface, such that a gap exists between the corner of the paper and the board to facilitate grasping of the paper.

14. The apparatus of claim 13, wherein the board comprises a material that retains an amount of static electricity sufficient to attract and retain the paper on the drawing surface.

15. The apparatus of claim 10, wherein at least one of the uncovered bonder regions includes a recessed area at a location generally coinciding with a corner of the paper when placed on the drawing surface, such that a gap exists between the corner of the paper and the board to facilitate grasping of the paper.

16. The apparatus of claim 12, wherein the drawing instrument is triangularly shaped.

17. The apparatus of claim 1, wherein the border pieces are fastened to the board in a location that holds the paper snugly and removably in place on the drawing surface.

18. The apparatus of claim 1, wherein the board comprises a material that retains an amount of static electricity sufficient to attract and retain the paper on the drawing surface.

* * * * *